United States Patent [19]

Putnam

[11] 4,002,142

[45] Jan. 11, 1977

[54] FILM STRIPING APPARATUS

[75] Inventor: Dean H. Putnam, Toledo, Ohio

[73] Assignee: Dietzgen Corporation, Chicago, Ill.

[22] Filed: May 9, 1975

[21] Appl. No.: 576,093

[52] U.S. Cl. ..... 118/68; 118/211; 118/235; 118/249

[51] Int. Cl.[2] ..... B05C 1/08; B05C 1/16

[58] Field of Search ..... 118/33, 65, 68, 235, 118/246, 249, 211; 34/155

[56] References Cited

UNITED STATES PATENTS

| | | | |
|---|---|---|---|
| 771,662 | 10/1904 | Peck | 118/246 |
| 2,220,071 | 11/1940 | Avery | 118/33 X |
| 2,631,562 | 3/1953 | Gerard | 118/65 X |
| 2,710,590 | 6/1955 | Gerard | 118/65 |
| 3,683,846 | 8/1972 | Flournoy et al. | 118/235 X |
| 3,750,305 | 8/1973 | Loser | 34/155 X |
| 3,788,271 | 1/1974 | Carpenter et al. | 118/235 X |
| 3,820,504 | 6/1974 | Dahl | 118/68 |

*Primary Examiner*—John P. McIntosh
*Attorney, Agent, or Firm*—Johnston, Keil, Thompson & Shurtleff

[57] ABSTRACT

An apparatus for applying a stripe to the surface of a continuous strip of film material. The film is drawn from a roll of film wound on a supply reel and through a striping station where a striping material is applied to a predetermined zone on the upper surface of the film. Next, the film is drawn around a plurality of drying rollers which are positioned to form a generally rectangular, inwardly spiraling drying path. The film with the dried striping zone is collected on a take-up reel which is motor driven in co-operation with a drawing roller. The drawing roller draws the film from the supply roller, through the striping station and around the drying path.

9 Claims, 9 Drawing Figures

74
12
94
106
105
107
12
101
99
78
111
83
82
84
81
79
74
91
77
109
108
75
75
72
89
87
85
96
93
95
113
88
76
97
71
72

139
133
133
98
121
121
125
123
122
124
73
74
131
132
121
138
134
137
136
135
139
166
133

109
161
143
112
142
103
147
141
148
196
193
197
195
144
113
121
21
121
102
146
121
198
104
145
16
121
17
194
19
18
15
14

13
23
191
23

FILM STRIPING APPARATUS

BACKGROUND OF THE INVENTION

1. Field of the Invention

This invention relates in general to an apparatus for striping film and in particular to such an apparatus with a striping material application station followed by a relatively compact drying path.

2. Description of the Prior Art

Previous apparatus for applying a liquid substance to a quantity of film have tended to be large and bulky since a relatively large area was required for the drying operation. U.S. Pat. No. 2,224,367 issued on Dec. 10, 1940 to F. LaGrande discloses a film coating apparatus having a film drying cabinet. The cabinet includes sets of flanged rollers arranged to form a drying path in a series of spiral loops back and forth, transversely of the cabinet, and progressively from the rear to the front of the cabinet. U.S. Pat. No. 1,569,048 issued on Jan. 12, 1926 to F. J. J. Stock discloses an apparatus for regenerating cinematographic films having a series of rollers for directing the film in the manner of a worm conveyor from the input end to the output end of a drying chamber.

In each of the above-identified patents, as well as other prior art, the apparatus disclosed utilizes a path of travel which requires many sharp 180° reversals of the film during the drying process. Such sharp reversals tend to stress the film which weakens it and lessens its life. Therefore, it would be advantageous to provide a path of travel for the film which is compact yet eliminates the sharp reversals in direction.

SUMMARY OF THE INVENTION

The present invention relates to an apparatus for applying a striping material to a predetermined zone on the surface of a roll of film. A quantity of film is wound on a supply reel from which it is drawn through a striping station where the striping material is applied to a predetermined zone by a striping wheel. The striping wheel is supplied with liquid striping material picked up during contact with a striping material pick-up wheel which is partially immersed in a pool of striping material maintained by the automatic dispensing of striping material from a striping material dispensing bottle.

The film is then drawn around a plurality of drying rollers mounted to define a generally rectangular, inwardly spiraling drying path. The film with the dried striping zone is collected on a take-up reel which is motor driven in co-operation with a drawing roller. The drawing roller draws the film from the supply reel, through the striping station, and around the drying path.

It is the object of the present invention to provide an apparatus capable of striping, drying and collecting film while avoiding contact with the striped surface until the stripe is dry.

It is another object of the present invention to provide an apparatus for striping and drying film having a compact drying path which eliminates sharp reversals in direction and avoids displacement in the plane of the film.

DESCRIPTION OF THE PREFERRED EMBODIMENT

Figure 1:
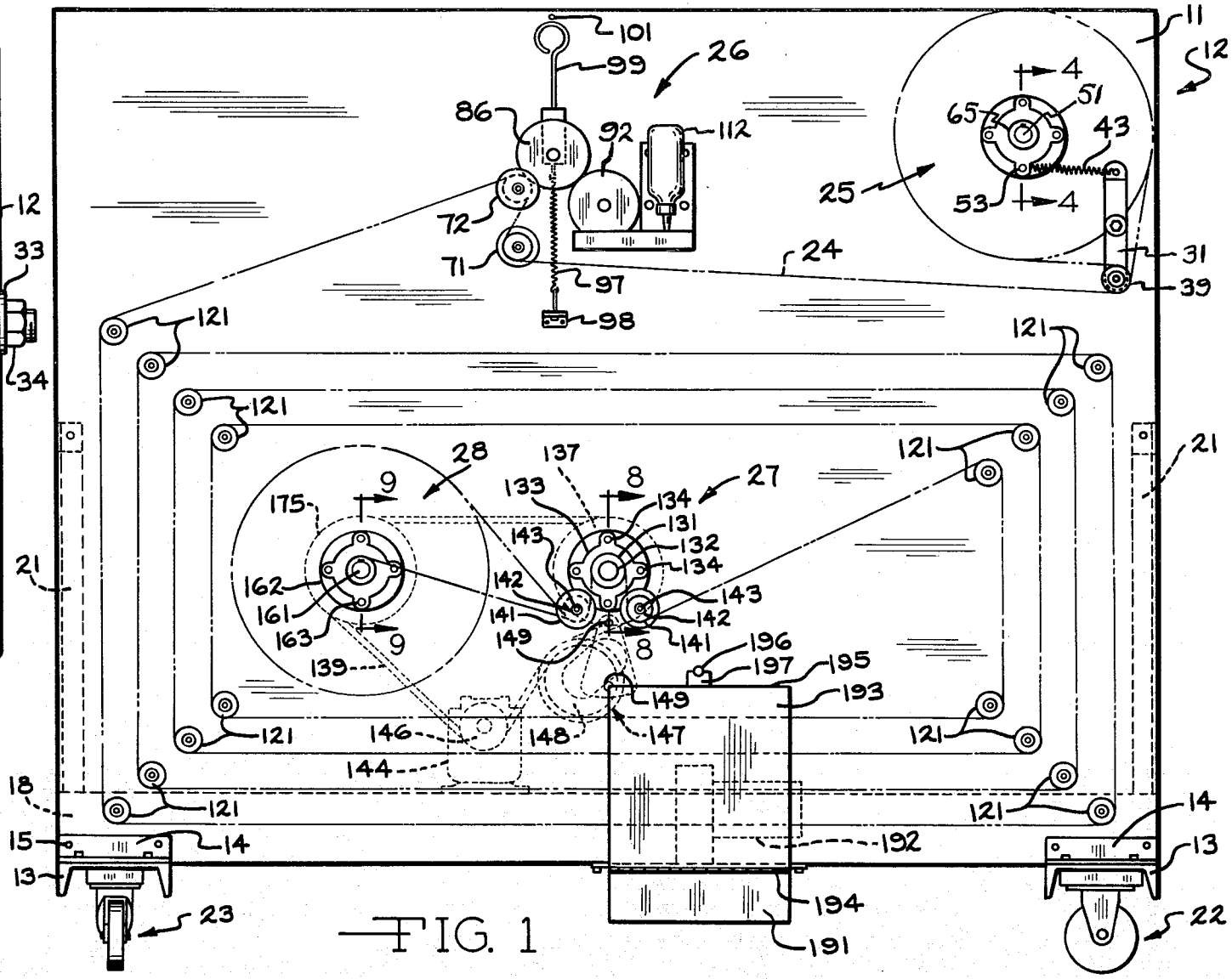
FIG. 1 is a front elevational view of the striping apparatus according to the present invention.
Figures 2, 6, 7, 8:
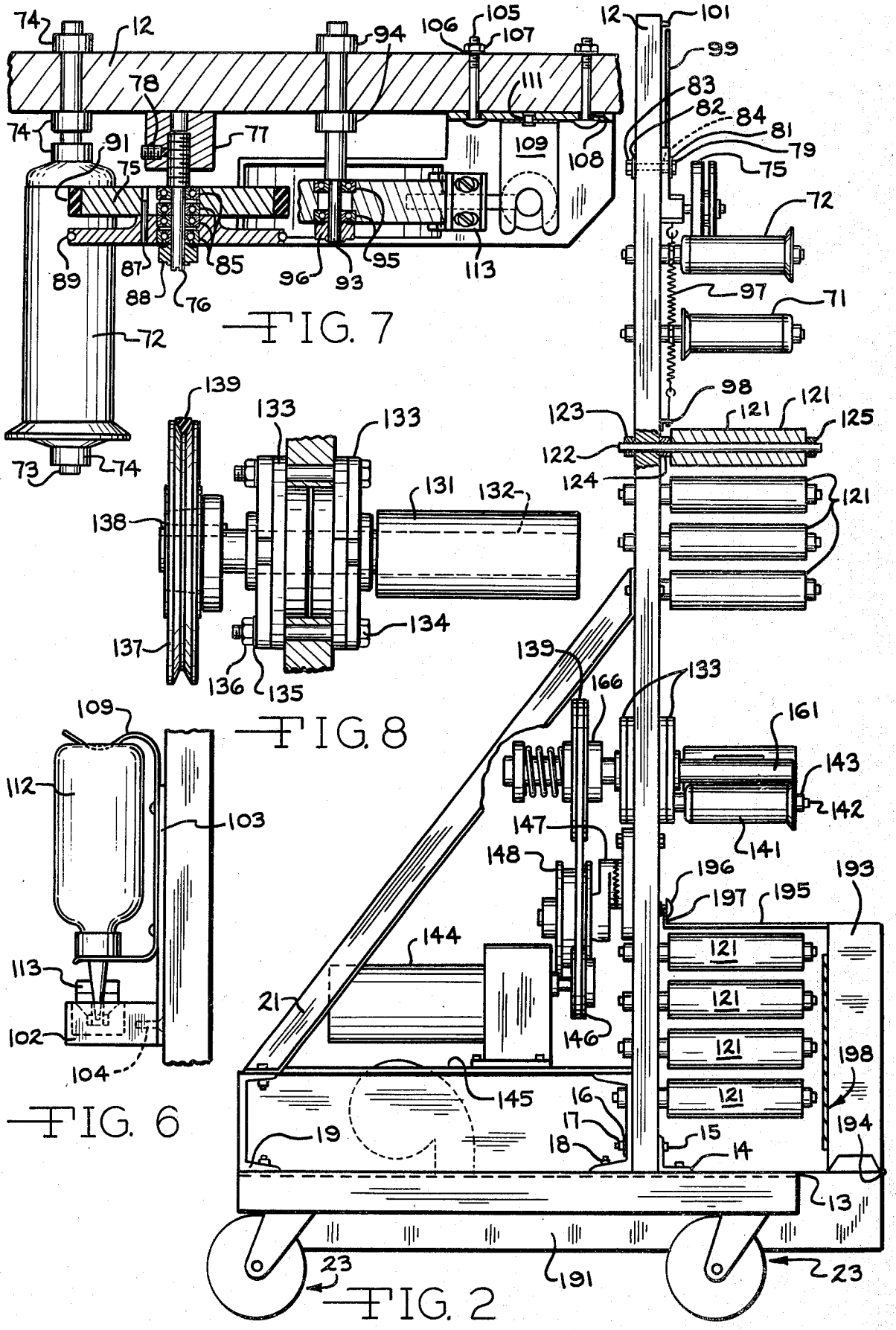
FIG. 2 is a side elevational view of the striping apparatus shown in FIG. 1.
FIG. 6 is an enlarged fragmentary side elevational view of the ink dispensing mechanism of the striping apparatus shown in FIG. 1.
FIG. 7 is an enlarged fragmentary cross-sectional view taken along line 7—7 of FIG. 5.
FIG. 8 is an enlarged fragmentary cross-sectional view taken along line 8—8 of FIG. 1.

Referring to FIGS. 1 and 2, there is shown a front elevational view and a side elevational view respectively of an apparatus for striping film. Typically, the film is microfilm and the stripe is applied as a contrasting background for identifying characters on the film. The film is drawn from a roll of unstriped film wound on a supply reel and through a striping station where a striping material is applied to a predetermined zone on the upper surface of the film. Next, the film is drawn around a plurality of drying rollers which are positioned to form a generally rectangular, inwardly spiraling drying path. The film with the dried striping material is collected on a take-up reel which is motor driven to wind the film into a roll. The take-up reel is driven in co-operation with a drawing roller which draws the film around the drying path from the supply reel.

The various rollers in the striping station are attached to a front surface 11 of a mounting plate 12 positioned in a vertical plane. The mounting plate 12 is attached at the opposite ends of its lower longitudinal edge to a pair of base plates 13 proximate one end of the base plates. The base plates 13 are formed from a U-shaped channel material and are positioned with the channel opening facing downwardly. A pair of right angle brackets 14 have one leg attached to the front surface 11 of the mounting plate 12 and have the other leg attached to the upwardly facing bottom surface of the U-shaped base plates 13 by any suitable means such as cap screws 15, lockwashers 16 and nuts 17. A first rear bracket 18 is formed from a U-shaped channel material and is attached to the mounting plate 12 along the lower longitudinal edge of the mounting plate with the channel opening facing rearwardly. The forwardly facing bottom surface of the U-shaped rear bracket 18 abutts the rear surface of the mounting plate 12 and may be attached thereto in any suitable fashion such as by the same cap screws 15, lockwashers 16, and nuts 17 as are utilized to attach the angle brackets 14 to the mounting plate 12. The lower leg of the first rear bracket 18 may be attached to the base plates 13 by any suitable means such as by welding. Therefore, the lower longitudinal edge of the mounting plate 12 is fixedly attached to the base plates 13 along the front surface 11 by the right angle brackets 14 and along the rear surface by the first rear bracket 18.

A second rear bracket 19, similar to the first rear bracket 18, is attached to the base plates 13 at the ends thereof, opposite the ends proximate the mounting plate 12. The rear bracket 19 may be positioned parallel to the first rear bracket 18 with its channel opening facing forwardly and may be attached by welding the lower leg thereof to the base plates 13. A pair of right angle braces 21 are connected between the upper leg of the second rear bracket 19 and a point on the rear surface of the mounting plate 12 midway between the upper and lower longitudinal edges thereof. The braces may be attached to the bracket 19 by any suitable means such as cap screws, lock-washers and nuts. The base plates 13, the right angle brackets 14, the rear brackets 18 and 19 and the right angle braces 21 form a rigid supporting structure for the mounting plate 12. This mounting structure may be made mobile by the addition of a pair of fixed casters 22, and a pair of swivel casters 23 to the base plate 13. The casters may be attached by any suitable means such as welding.

Referring to FIG. 1, there is shown as a phantom line a path of travel 24 for the film which is not shown so as not to obscure the various elements mounted on the front surface 11 of the mounting plate 12. The unstriped film is wound on a supply reel which is not shown so as not to obscure a supply mechanism 25. As shown by the path of travel 24, the film may be drawn from a supply reel which has been wound in either a clockwise or counterclockwise direction. The path of travel 24 leads through a striping station 26 to a plurality of drying rollers which are positioned to form a generally rectangular, inwardly spiraling drying path. The film is drawn along the path of travel 24 by a drawing roller mechanism 27. The film is collected on a take-up reel which is motor driven in co-operation with the drawing roller mechanism 27. The take-up reel (not shown) is mounted on a take-up mechanism 28.

Figure 3:
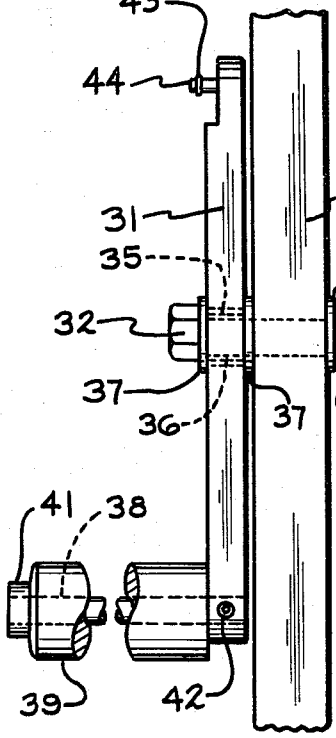
FIG. 3 is an enlarged fragmentary side elevational view of the supply roller tensioning mechanism of the striping apparatus shown in FIG. 1.

Referring to FIGS. 1 and 3, there is shown a tensioning mechanism for the film wound on the supply reel. A tensioning arm 31 is pivotally attached to the front surface 11 of the mounting plate 12 by a cap screw 32, a lock-washer 33 and a nut 34. The tensioning arm 31 may have an aperture formed therein approximately equidistant from the ends of the arm into which a sintered bronze sleeve bearing 35 is press fitted. The cap screw 32 passes through the hollow center of a sleeve spacer 36 which is trapped between a pair of flat washers 37 when the nut 34 is tightened against the lockwasher 33. The tensioning arm 31 is free to rotate on the inner surface of the sintered bronze sleeve bearing 35 which contacts the outer surface of the sleeve spacer 36. A roller shaft 38 is inserted into an aperture in the lower end of the tensioning arm 31 and carries thereon a tensioning roller 39 which is free to rotate about the axis of the roller shaft 38. The tensioning roller 39 is maintained on the roller shaft 38 by a press fitted set collar 41 at the free end of the roller shaft 38. The opposite end of the roller shaft 38 is retained in the aperture in the tensioning arm 31 by an axially positioned socket head set screw 42. The upper end of the tensioning arm 31 is connected to one end of a tensioning spring 43. The other end of the tensioning spring 43 is fixed to the supply mechanism 25 such that the tensioning spring 43 supplies a force opposing the force applied to the tensioning arm 31 by the drawing of the film from the supply reel. The tensioning arm 31 and the tensioning spring 43 act as a shock absorber when the drawing roller mechanism first starts up. They also provide a force which resists the continuous drawing force such that the relatively low inertia supply reel does not overrun the rate of drawing of the film thereby generating loops in the film. The tensioning spring 43 may be attached to the tensioning arm 31 by any suitable means by such as a pin 44.

Figure 4:
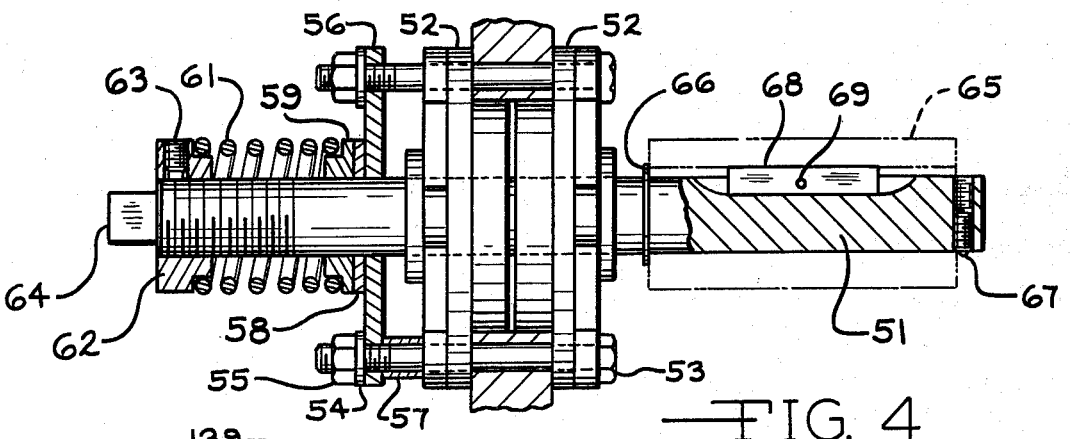
FIG. 4 is an enlarged fragmentary cross-sectional view taken along line 4—4 of FIG. 1.

As shown in FIGS. 1 and 4, a supply reel shaft 51 is rotatably attached to the mounting plate 12. The shaft 51 rotates in a pair of flanged pillow blocks 52 which are attached to the mounting plate 12 by any suitable means such as cap screws 53, lockwashers 54 and nuts 55. The tensioning spring 43 may be attached to the head of one of the cap screws 53. A friction plate 56 is trapped between the nut 55 and lockwasher 54 and a spacer 57 which abutts the rear flanged pillow block 52. A friction disc 58 is pressed between a spring guide 59 and the friction plate 56 by the force applied from a spring 61. The spring 61 acts against a pressure adjusting nut 62 which threadably engages the shaft 51 and is fixed thereto by a socket head set screw 63. The rear end of the shaft 51 has formed thereon a square end for holding the shaft while the pressure adjusting nut 63 is threadably rotated on the shaft 51 to change the force applied by the spring 61.

The opposite end of the supply reel shaft 51 retains a supply reel 65 shown in phantom. One end of the supply reel 65 abutts a C-shaped snap action ring 66 which engages an annular recess in the shaft 51. The other end of the supply reel 65 abutts a ball plunger 67 which permits the supply reel 65 to be installed on and removed from the shaft 51, yet retains the supply reel 65 on the shaft during rotation thereof. A key 68 is retained in a longitudinal slot formed in the shaft 51 by a roll pin 69. The key 68 co-operates with a slot formed in the supply reel 65 to force the shaft 51 to rotate with the supply reel 65 as the film is drawn therefrom. The spring pressure friction plate 56 and the friction disc 58 tend to prevent overrunning of the supply reel 65 and shaft 51 as the film is drawn from the supply reel 65.

Figure 5:
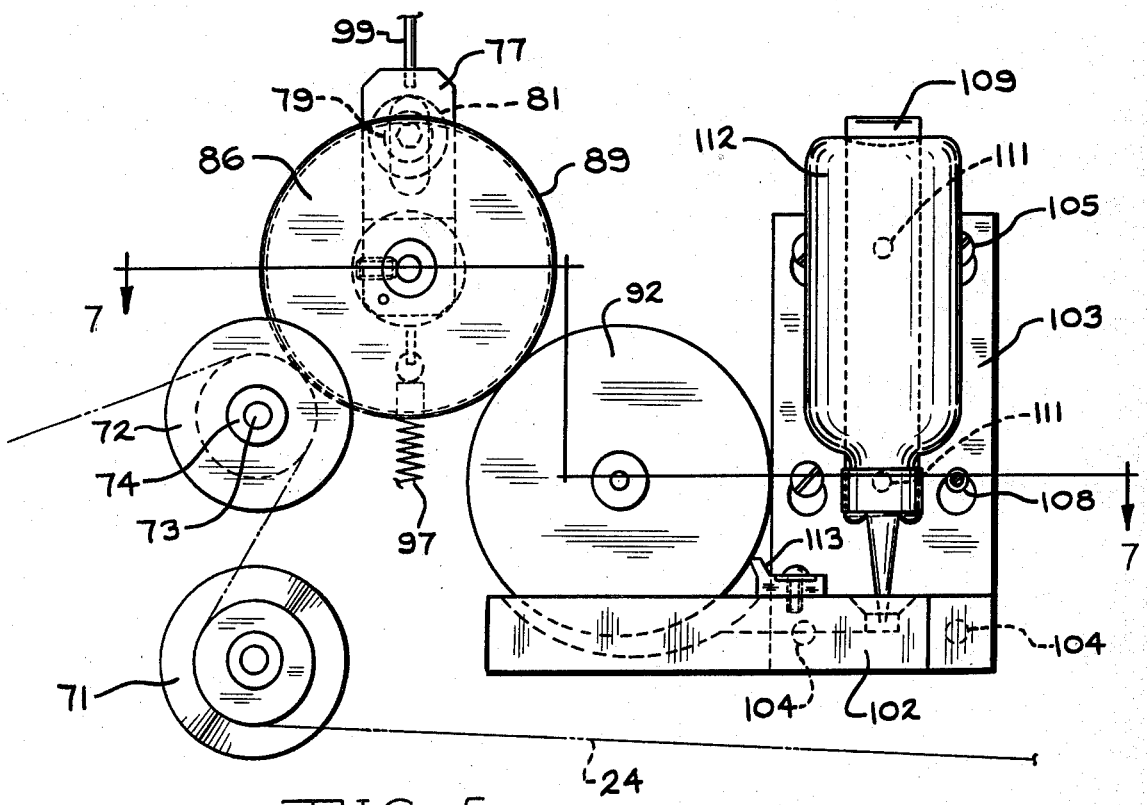
FIG. 5 is an enlarged fragmentary front elevational view of the ink dispensing mechanism of the striping apparatus shown in FIG. 1.

The film is drawn along the travel path 24 through the striping station 26. The film is guided through the striping station 26 by a pair of flanged rollers 71 and 72. The roller 71 is mounted with its flange near the mounting plate 12 and the roller 72 is mounted with its flange away from the mounting plate 12 to guide the film into contact with a striping wheel. Since the rollers 71 and 72 are mounted in a similar manner, only the mounting of the roller 72 will be described. Referring to FIGS. 5, 6 and 7, there is shown the roller 72 retained on a roller shaft 73 by a pair of set collars 74. The roller shaft 73 extends through the mounting plate 12 and is attached thereto by a pair of set collars 74. The rollers 71 and 72 maintain the rearward longitudinal edge of the film in contact with the peripheral edge surface of a striping wheel 75.

The striping wheel 75 is rotatably retained on a striping wheel shaft 76. The shaft 76 is retained in a striping wheel mounting block 77 by a socket head set screw 78. The mounting block 77 is slidably attached to the front surface 11 of the mounting plate 12 by a cap screw 79, flat washer 81, lockwasher 82 and nut 83. The cap screw 79 is inserted in a spacer sleeve 84 which in turn is inserted in a vertical slot formed in the mounting bracket 77. The spacer 84 is trapped between the head of the cap screw 79 and the front surface 11 of the mounting plate 12 when the nut 83 is tightened against the lockwasher 82 and the rear face of the mounting plate 12. The thickness of the mounting block 77 is slightly less than the length of the spacer sleeve 84 such that the mounting block 77 is free to move in a vertical direction until either end of the vertical slot engages the spacer sleeve 84. The striping wheel 75 has press fitted into the center thereof a pair of ball bearings 85. A drive wheel 86 also has a pair of ball bearings 85 press fitted into the center thereof. The striping wheel 75 and the drive wheel 86 are connected for simultaneous rotation by a roll pin 87. The interconnected striping wheel 75 an drive wheel 86 are held against a shoulder on the shaft 76 by a clamping collar 88. The drive wheel 86 has formed along the peripheral edge thereof, a continuous driving surface 89 which frictionally engages the surface of the film passing around the roller 72. The driving surface 89 may be formed of a rubber-like substance which provides a frictional driving contact with the drawn film. The movement of the film rotates the drive wheel 86 which in turn rotates the striping wheel 75. The striping wheel 75 has formed on the peripheral edge thereof, a striping surface 91 which absorbs the liquid striping material yet generates a smooth even distribution of the striping material on the surface of the film on contact therewith. Typically, the striping surface 91 is formed of a felt-like material.

The striping wheel 75 picks up the striping material from a pick-up wheel 92. The pick-up wheel 92 is rotatably attached to a pick-up wheel shaft 93 which extends through the mounting plate 12 and is attached thereto by a pair of set collars 94. The pick-up wheel 92 has press fitted in the center thereof a pair of ball bearings 95. The pick-up wheel 92 is held against a shoulder on the pick-up wheel shaft 93 by a clamping collar 96. The drive wheel 86 is held in engagement with the flanged roller 72 and striping wheel 75 is held into engagement with the flanged roller 72 and the pick-up wheel 92 by the force exerted by a spring 97 which has one end thereof attached to the lower end of the striping wheel mounting block 77 and has the other end thereof attached to a bracket 98 which in turn is attached to the front surface 11 of the mounting plate 12. The striping wheel 75 and the drive wheel 86 may be disengaged from the roller 72 by moving the striping wheel mounting block 77 in an upward direction. The mounting block 77 has a pull ring 99 attached to the upper end thereof for moving the block 77 in an upward direction. The pull ring 99 may be looped over a roll pin 101 extending horizontally from the front surface 11 of the monitoring plate 12 to maintain the striping wheel 77 and the drive wheel 86 in disengagement.

The pick-up wheel 92 is partially immersed in a pool of liquid striping material maintained in a reservoir 102. The reservoir 102 is attached to a reservoir mounting bracket 103 by a pair of flat head screws 102 which are countersunk into the rear face of the bracket 103. The reservoir mounting bracket 108 is attached to the front surface 11 of the mounting plate 12 by truss head screws 105, lockwashers 106 and nuts 107. The mounting holes in the bracket 103 are larger in diameter and the heads in the screws 105 so that the bracket 103 and reservoir 102 may be removed from the mounting plate 12 without unscrewing the screws 105. Along the upper edge of each of the mounting holes, there is formed a semi-circular cutout having a diameter equal in diameter to a spacer 108. When the nuts 107 are tightened against the lock washers 106 and the rear surface of the mounting plate 12, the spacers 108 are trapped between the heads of the screws 105 and the front surface 11. If the length of the spacers 108 is slightly greater than the thickness of the bracket 103, the bracket 103 and the reservoir 102 will rest on the spacers 108 and may be moved in a vertical direction until the mounting holes are in alignment with the heads of the screws 105. Then the bracket 103 and the reservoir 102 can be removed from the mounting plate 12.

A dispensing bottle bracket 109 is attached to the mounting bracket 103 with a pair of countersunk rivets 111. The bottle bracket 109 has a finger formed at either end thereof for retaining a dispensing bottle 112. The lower finger has a slot formed therein to receive the neck of the bottle 112. The upper finger is formed in an S-shaped curve to provide a spring force against the end of the bottle 112, thereby retaining it in a vertical position between the upper and lower fingers. The bottle 112 has a cone-shaped neck with an aperture formed in the end thereof for dispensing liquid striping material into a cone-shaped aperture in the upper surface of the reservoir 102. A channel leads from the cone-shaped aperture to a wider channel having a semi-circular bottom to direct the striping material from the dispensing bottle to the pool of striping material contained in the wide channel. As the pick-up wheel 92 rotates, it draws striping material from the pool which drops the upper surface of the striping material in the pool, the channel and the cone-shaped aperture below the aperture formed in the cone-shaped neck of the bottle 112. This allows air to enter the bottle and striping material to flow from the bottle to the aperture and the cone-shaped neck, thereby raising the level of the striping material in the reservoir until the aperture is once again covered. A doctor blade 113 is attached to the reservoir 102, by any suitable means such as screws, proximate the edge surface of the pick-up wheel 92. As the pick-up wheel 92 rotates, the doctor blade removes the excess striping material from the surface of the wheel and returns it to the pool thereby providing a smooth, even coating of striping material to the striping wheel 75.

When the film leaves the striping station 26 it is guided in a generally rectangular, inwardly spiraling compact drying path by a plurality of drying rollers 121. The side of the film opposite the striped side contacts the surface of each roller in succession to direct the film to the drawing roller mechanism 27 and take-up mechanism 28. Although the axis of each of the rollers 121 (except the first and the last) is shown as being at the apex of a right angle formed with its two adjacent rollers, the rollers 121 may be located in any suitable pattern in order to maximize the length of the drying path in the allotted area.

Each of the rollers 121 is rotatably attached to a shaft which extends through the mounting plate 12. For example, in FIG. 2, shaft 122 is attached to the mounting plate 12 by a pair of set collars 123 and 124. The roller 121 is mounted on the shaft 122 and is retained against the set collar 124 by a third set collar 125. Each of the rollers 121 is therefore positioned the same distance from the front face 11 of the mounting plate 12 to direct the film in a path defining a plane parallel to the front surface 11.

Referring to FIGS. 1, 2 and 8, there is shown the drawing roller mechanism 27. A drawing roller 131 frictionally engages the unstriped surface of the film to pull the film from the supply reel (not shown), through the striping station 26 and around the path defined by the drying rollers 121. The drawing roller 131 is attached to a roller shaft 132 which is rotatably mounted in a pair of flanged pillow blocks 133. The pillow blocks may be attached to the front and rear surfaces of the mounting plate 12 by cap screws 134, lock-washers 135 and nuts 136.

A sheave 137 is attached to the end of the shaft 132 opposite the roller 131 by a key 138 which engages co-operating slots in the shaft 132 and the sheave 137. A motor driven belt 139 engages a groove in a sheave 137 to turn the drawing roller 131. A pair of flanged rollers 141 are mounted on the front surface 11 of the mounting plate 12 to position the film so that it is in contact with approximately one half of the surface area of the drawing roller 131 at all times. Each of the rollers 141 is rotatably mounted on a roller shaft 142 which in turn extends through and is attached to the mounting plate 12 by a pair of set collars in a manner similar to the drawing rollers 121. A third set collar 143 retains the roller 141 on the roller shaft 142.

A gear motor 144 drives the belt 139 which in turn drives the sheave 137 and the take-up mechanism 28. The gear motor 144 is attached to a motor mounting plate 145 which may be welded to the upper leg of each of the rear brackets 18 and 19. A drive sheave 146 is attached to the end of the gear motor shaft and engages the belt 139 with its groove to provide a friction drive of the belt. The tension on the belt 139 is adjusted with a drive tensioner 147 and associated pulley 148. The drive tensioner 147 is attached to the rear surface of the mounting plate 12 with cap screws 149, flat washers, lockwashers and nuts. The drive tensioner pulley 148 is rotably attached to an arm of the drive tensioner 147 which in turn is rotatably attached to the body of the drive tensioner. The tensioner arm and body have opposing surfaces on which are formed radially positioned ratchet-like teeth which interlock. The arm may be rotated in a direction to take up slack in the belt 139 and thereby increase the tension on the belt, but the interlocking action of the teeth resist rotation of the arm in the opposite direction.

Figure 9:
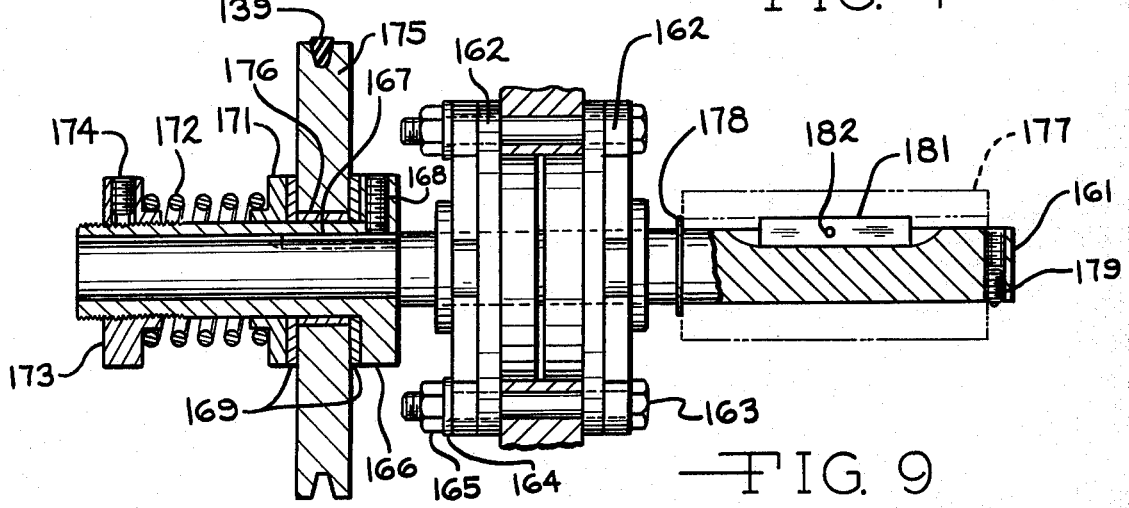
FIG. 9 is an enlarged fragmentary cross-sectional view taken along line 9—9 of FIG. 1.

As shown in FIGS. 1, 2 and 9, the take-up mechanism includes a take-up reel shaft 161 which is rotatably attached to the mounting plate 12. The shaft 161 rotates in a pair of flanged pillow blocks 162 which are attached to the mounting plate 12 by any suitable means such as cap screws 163, lock-washers 164 and nuts 165. The end of the shaft 161 extending through the rear surface of the mounting plate is inserted into a friction sleeve 166 which abutts a shoulder on the shaft. The sleeve 166 is attached to the shaft 161 by a key 167 which co-operates with slots in the sleeve and shaft. An axially positioned socket head set screw 168 is threaded into the sleeve 166 and engages the key 167 to prevent the sleeve from sliding off the shaft 161. A pair of friction discs 169 are pressed between a spring guide 171 and the friction sleeve 166 by a force applied from a spring 172. The spring 172 acts against a pressure adjusting nut 173 which threadably engages the friction sleeve 166 and is fixed thereto by a socket head set screw 174. The pressure adjusting nut 173 is threadably rotated on the sleeve 166 to change the force applied by the spring 172. A sheave 175 is mounted on the sleeve 166 and is trapped between the friction discs 169 for rotation with the shaft when driven by the belt 139.

The sheaves 137 and 175 are the same diameter and therefore are driven at the same rotational speed by the gear motor 144. However, as the roll of film on the take-up reel (shown in phantom) increases in diameter, the rotational speed of the take-up roller must decrease in order to wind the same length of film as passes around the drawing roller 131 in a given period of time. The frictional force that resists the slipping of the film on the drawing roller 131 and flanged rollers 141 tends to cause slipage between the takeup reel shaft 161 and the sheave 175. The sheave 175 rotates on a sintered bronze sleeve bearing 176 when the resisting frictional force on the film exceeds the frictional force developed between the friction disc 169 and the friction sleeve 166 by the spring 172.

The opposite end of the take-up reel shaft 161 retains a take-up reel 177 shown in phantom. One end of the take-up reel 177 abutts a C-shaped snap action ring 178 which engages an annular recess in the shaft 161. The other end of the take-up reel 177 abutts a ball plunger 179 which permits the take-up reel to be installed on and removed from the shaft 161, yet retains the take-up reel 177 on the shaft during rotation thereof. A key 181 is retained in a longitudinal slot formed in the shaft 161 by a roll pin 182. The key 181 co-operates with a slot formed in the take-up reel 161 to force the take-up reel 177 to rotate with the shaft 161 as the film is wound up.

The drying path may also include a section having forced air drying means. A blower duct 191 is flanged along its upper longitudinal edges and may be attached to the lower legs of the rear brackets 18 and 19 by any suitable means such as cap screws, lock washers and nuts. A blower motor and fan 192 is mounted on the upper surface of the duct 191 between the brackets 18 and 19 and supplies moving air. A drying chamber 193 is formed at the front end of the duct 191 and may be connected thereto by a piano hinge 194 which permits the chamber 193 to be pivoted away from the front surface 11 of the mounting plate 12. The top surface 195 of the chamber 193 is extended over the lower horizontal portions of the drying path 24 and may be attached to the front surface 11 of the mounting plate 12 as by the engagement of the head of the latching pin 196 with a U-shaped catch 197. The rear surface of the chamber 193 has a louvered area 198 which directs the stream of moving air over the sections of film to aid in the drying of the striping material.

In summary, the present invention is an apparatus for striping film, such as microfilm, wherein a stripe is applied as a contrasting background for identifying characters. The film is drawn from a roll of unstriped film wound on a supply reel and through a striping station 26 where a striping material is applied to a predetermined zone on the upper surface of the film. Next, the film is drawn around a plurality of drying rollers 121 which are positioned to form a generally rectangular, inwardly spiraling compact drying path. The film with the dried striping material is collected on a take-up reel which is motor driven to wind the film into a roll. The take-up reel is driven in cooperation with the drawing roller 131 which draws the film around the drying path from the supply reel.

Although the present invention has been disclosed in terms of an apparatus for applying striping material to a surface of a continuous strip of film, it will be recognized that any continuous strip material may be drawn through the present invention wherein a liquid material is to be applied to a surface of that strip material. Furthermore, the width of the stripe may be changed by utilizing a striping wheel 75 of a different width.

In accordance with the provisions of the patent statutes, I have explained the principle and mode of operation of my invention and have illustrated and described what I now consider to represent its best embodiment. However, I desire to have it understood that the invention may be practiced otherwise than as specifically illustrated and described without departing from its spirit or scope.

What I claim is:

1. An apparatus for applying a stripe to a surface of a continuous strip of photographic film, comprising:

a. means for storing the unstriped photographic film, said storage means including a film strip tensioning means, a rotatably mounted supply reel shaft for receiving a roll of unstriped film wound on a reel and a friction disc attached to said supply reel shaft and cooperating with a fixedly mounted friction plate to prevent overrunning of the reel shaft and the reel;

b. means for applying striping material to a predetermined zone on the surface of the film as the film is drawn therethrough, said striping means including a drive wheel rotatably mounted and having a peripheral surface in driven contact with the film surface and a striping wheel rotatably mounted in driven relationship with said drive wheel and having a peripheral surface in contact with a predetermined zone of said film surface for applying a liquid striping material thereto;

c. means for defining an inwardly spiraling drying path for the striped film without engaging the predetermined surface of the film;

d. means for collecting the dried striped film; and e. means for drawing the film from said storage means, through said striping means and said drying path defining means, and to said collecting means, said drawing means including a rotatably mounted drawing roller having a peripheral surface for engagement with the film surface, means for driving said drawing roller, and a pair of flanged rollers rotatably mounted for guiding the film surface into contact with a predetermined portion of said peripheral surface of said drawing roller.

2. An apparatus according to claim 1 wherein said film strip tensioning means includes a tensioning arm pivotally mounted for rotation about a point between the ends thereof, one end of said arm having a roller rotatably attached thereto whereby the film is drawn around said roller causing said arm to rotate in one direction and said other end of said arm having one end of a spring attached thereto, said other end of said spring being fixedly mounted whereby said spring exerts a force to cause said arm to rotate in the other direction.

3. An apparatus according to claim 1 wherein said striping means includes a pair of flanged rollers rotatably mounted for guiding the film through said striping means; a pick-up wheel partially immersed in a pool of said striping material and having a peripheral surface in contact with said peripheral surface of said striping wheel for applying said striping material thereto; a reservoir for forming said pool of said striping material; and dispensing means for replacing said striping material in said reservoir as said striping material is drawn from said pool by said pick-up wheel.

4. An apparatus according to claim 1 wherein said drying path defining means is a plurality of rotatably mounted rollers.

5. An apparatus according to claim 4 wherein said rollers are positioned such that any three successive ones of said rollers along said drying path define the apex and sides of a right triangle.

6. An apparatus according to claim 1 wherein said drying path defining means includes a duct for directing a stream of moving air over a selected section of said drying path and blower means for supplying said moving air to said duct.

7. An apparatus according to claim 1 wherein said collecting means includes a rotatably mounted take-up reel shaft for receiving a reel for winding the striped film into a roll, means for driving said take-up reel shaft and slip clutch means connecting said take-up reel shaft and said driving means.

8. An apparatus according to claim 1 wherein said drawing means includes a drive sheave in driving engagement with said drawing roller, wherein said driving means includes a gear motor connected to said drive sheave by a belt for rotating said drive sheave, and wherein said drawing means includes belt tensioning means for adjusting the tension on said belt.

9. An apparatus according to claim 1 wherein said storage means, said striping means, said drying path defining means, said collecting means and said drawing means are mounted on a planar surface.

* * * * *